US005323810A

United States Patent [19]

Cantatore

[11] Patent Number: 5,323,810

[45] Date of Patent: Jun. 28, 1994

[54] SULLAGE DIVERSION VALVE

[75] Inventor: Daniel Cantatore, Thornlands, Australia

[73] Assignee: Canmas Pty. Ltd., Queensland, Australia

[21] Appl. No.: 56,041

[22] Filed: Apr. 30, 1993

[30] Foreign Application Priority Data

May 5, 1992 [AU] Australia ..... PL2249
Jan. 11, 1993 [AU] Australia ..... 31120/93

[51] Int. Cl.[5] ..... F16K 11/00

[52] U.S. Cl. ..... 137/599.1; 137/876; 4/665

[58] Field of Search ..... 137/872, 876, 599.1; 4/665, 687, 682, 679

[56] References Cited

U.S. PATENT DOCUMENTS 4,836,250 6/1989 Krambrock ..... 137/876 X
5,210,886 5/1993 Coe, III ..... 4/665

FOREIGN PATENT DOCUMENTS 634710 2/1928 France .
241988 10/1925 United Kingdom .
436788 10/1935 United Kingdom .
442943 2/1936 United Kingdom .
2241276A 8/1991 United Kingdom .
2250770A 6/1992 United Kingdom .

*Primary Examiner*—John C. Fox
*Attorney, Agent, or Firm*—Robbins, Berliner & Carson

[57] ABSTRACT

A sullage diversion valve assembly (10) enables a user to selectively divert sullage to a waste line or to a hose for irrigation or other purposes. The valve assembly (10) is designed to be fitted to the outlet pipe (11) of a laundry tub (12) or other source of sullage, and comprises a rotary valve (20 ) operated by handle (23 ). When the valve is open, sullage flows to a waste pipe (16) as normal. However, when the valve is closed, the passage to the waste pipe (16) is blocked, and the sullage is diverted to an outlet (17) connected to the hose (18 ). An overflow outlet (19 ) is provided to enable sullage to flow to the waste line (16) in the event that the hose (18 ) is obstructed.

8 Claims, 2 Drawing Sheets

SULLAGE DIVERSION VALVE

Figure 1:
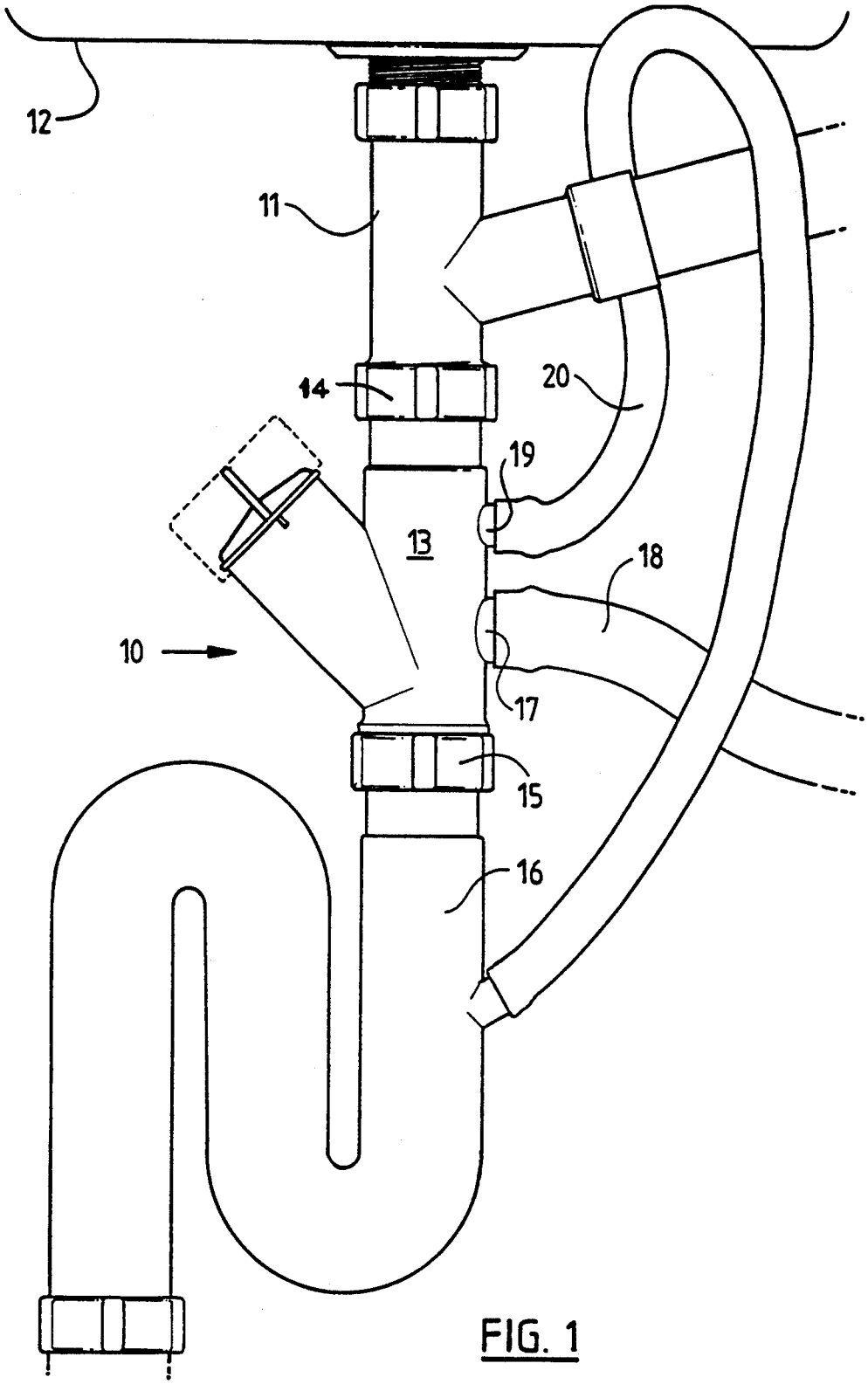

THIS INVENTION relates generally to water conservation, and in particular, to a sullage diversion valve assembly which enables water which would otherwise go to waste to be put to further use.

In this specification, the term "sullage" refers generally to used or waste water from bathrooms, showers, laundries and the like.

Household sullage is normally piped to a sewerage line, a sullage pit, or other waste. Although sullage is usually considered to be a waste product, it is normally comprised mostly of water with only a very small proportion of contaminants or actual waste products. Further, such contaminants or waste products are typically limited to detergents, most of which are biodegradable. Thus, the piping of sullage to sewerage represents a waste of that precious commodity—water.

It has been recognised that sullage can be "recycled" or put to further use, for example by using it to irrigate lawns and garden beds. To do so, some householders have disconnected the drain pipe from the laundry tub and reconnected a hose to the outlet of the laundry tub. This hose was then used for irrigation.

However, such alteration of household plumbing to redirect sullage for irrigation purposes has several inherent problems and disadvantages. First, the practice is unsafe as any blockage of the outlet hose or pipe will cause overflow in the laundry or bathroom with potentially serious consequences. Secondly, all the sullage from that particular outlet is directed to the irrigation hose, regardless of whether it is required or not. Thirdly, such alteration of household plumbing is normally contrary to local government regulations or water authority rules.

It is an object of the present invention to provide a sullage diversion valve assembly which enables sullage to be selectively and safely diverted for other uses.

In one broad form, the present invention provides a sullage diversion valve assembly comprising a housing having an inlet adapted to be connected to a source of sullage, a first outlet adapted to be connected to waste, and a second outlet; and valve means, whereby the valve means can be selectively operated by a user to divert sullage received through said inlet to either the first outlet or the second outlet.

Preferably, the housing also comprises an overflow outlet whereby in the event that the sullage level or pressure in the housing exceeds a predetermined amount, the sullage will be diverted automatically to waste thereby preventing any overflow at the source.

Typically, the housing is in the form of a tubular casing having the inlet at one end, and the first outlet at the other end. The second outlet and overflow outlet are suitably short pipe formations arranged transversely to the axis of the tubular casing, and communicating with the interior of the casing.

In the preferred embodiment, the valve means comprises a rotary valve having a rotor which is rotatable within a tubular extension of the casing and extends into the casing. The extension is angled obliquely to the axis of the casing, typically at 45° thereto. At its outer end, the rotor is provided with a handle, while the inner end of the rotor is angled obliquely to the rotational axis of the rotor. At a first rotational position, the rotor effectively blocks the passage through the tubular casing, thereby closing off the first outlet and diverting sullage received through the inlet to the second outlet. When the rotor is rotated 180° from this position, sullage can pass freely from the inlet to the first outlet. These two positions correspond to the closed and open positions, respectively, of the valve. In this manner, the user can divert the sullage, as required, either to waste (valve open) or to the second outlet (valve closed). The second outlet may be suitably connected to a garden hose or a gravity-fed irrigation network, a collecting tank, or other appropriate use.

The valve may have a graduated setting permitting partial opening so that a selected proportion of the sullage is diverted to waste while the remainder flows out the second outlet.

The valve assembly can suitably be made principally of plastics material, typically PVC plastics, by moulding. This enables the diversion valve assembly to be made at low cost and hence be readily affordable to the average householder. Furthermore, the diversion valve assembly can be installed in new plumbing installations or retrofitted to existing household plumbing.

In another broad form, the invention provides a plumbing installation comprising at least one inlet connected to a Source of sullage, a first outlet connected to sewage, sullage pit or other waste, a second outlet, and a manually operated valve selectively operable to direct sullage from the inlet to the first and/or second outlet. Preferably, the installation includes an overflow arrangement for directing sullage to waste in the event that the second outlet is blocked.

Figure 2:
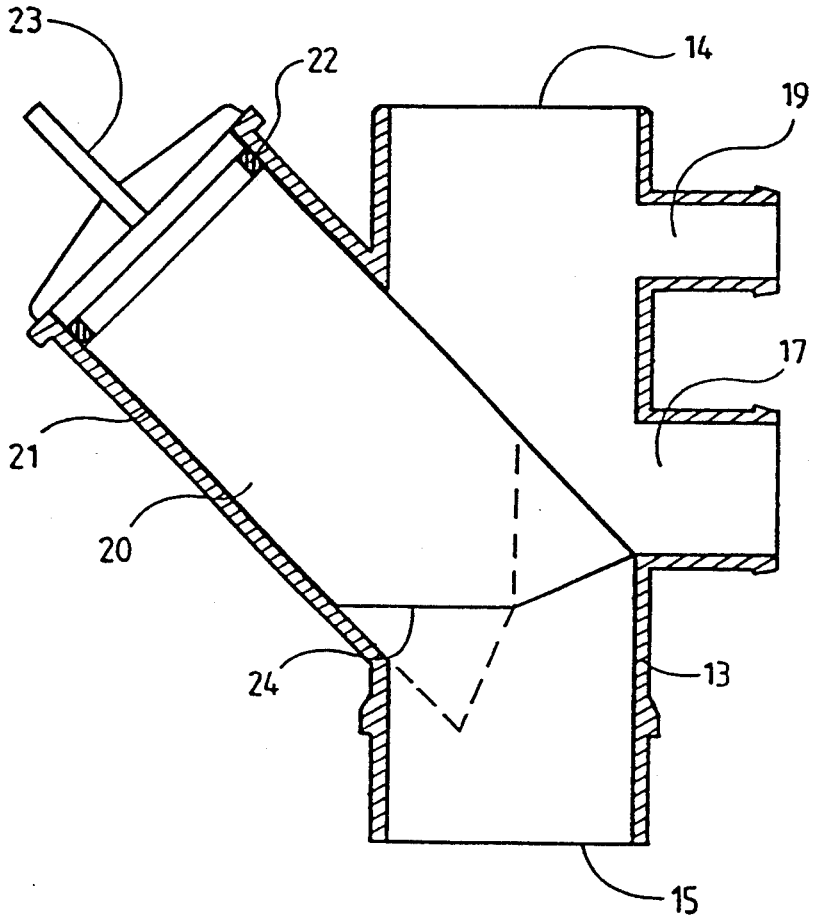

In order that the invention may be more fully understood and put into practice, a preferred embodiment thereof will now be described by way of example, with reference to the accompanying drawings in which:

FIG. 1 is a schematic elevational view of a sullage diversion valve assembly fitted to the outlet of a laundry tub; and FIG. 2 is a part sectional view of the diversion valve assembly of FIG. 1, showing the valve in its open and closed positions.

As shown in FIG. 1, the sullage diversion valve assembly 10 of the preferred embodiment is adapted to be connected to an outlet pipe 11 of a laundry tub 12. As shown in more detail in FIG. 2, the diversion valve 10 comprises a tubular housing 13 having an inlet fitting 14 adapted for connection to the tub outlet pipe 11. The housing 13 also has an outlet fitting 15 adapted to be connected to waste, such as pipe 16 leading to a sewer or sullage trench.

The housing 13 also comprises a hose outlet 17 adapted to be connected to a hose 18 or other conduit. The hose 18 can be connected to a lawn sprinkler, garden irrigator or other watering device, or fed to a tank for collecting the waste water.

The housing further comprises an overflow outlet 19 which is connected to the waste pipe 16 via an overflow hose 20. Preferably, the overflow hose 20 rises to approximately the level of the bottom of the tub 12 before joining the waste pipe 16, as illustrated in FIG. 1.

The valve assembly 10 is provided with valve means in the form of a manually operable rotary valve. The rotary valve comprises a rotor 20 of (solid or hollow) cylindrical section located within a tubular extension 21 of tubular casing 13. The tubular extension 21 is preferably angled at 45° to the axis of tubular casing 13. Although there is a close fit between rotor 20 and the internal cylindrical surface of tubular extension 21, the rotor 20 is freely rotatable within the extension 21. A seal, such as O-ring 22 provides sealing between the rotor 20 and the tubular extension 21.

A handle 23 is connected to the outer end of rotor 20. The handle 23 is suitably designed to be easily grasped by the hand and turned. The handle 23 may be provided with markings thereon to indicate the rotary position of the valve rotor.

The inner end 24 of rotor 20 extends into the passage through casing 13 and is cut obliquely to the axis of the rotor, as can be seen in FIG. 2. The inner end 24 effectively bridges across the through passage or bore of the tubular casing 13.

When the rotor 20 is in the rotational position shown in full outline in FIG. 2, the valve is open and any sullage received through inlet 14 passes through the bore of casing 13 to the waste pipe 16. However, when the rotor 20 is rotated 180° to the position shown in broken line in FIG. 2, the valve is effectively "closed" as the upper surface of the rotor 20 closes the bore of tubular casing 13, and diverts the sullage received through inlet 14 to the hose outlet 17. I t will therefore be apparent to those skilled in the art that the valve assembly can be opened or closed by a simple turn of the handle 23. The markings on the handle indicate to the user whether the sullage will be directed to the outlet hose 18 or to the sewer (or waste) pipe. Thus, the user can direct the sullage as required by a simple and quick action.

In the event that the outlet hose 18 is blocked while the valve is closed, the sullage will build up within casing 13 and eventually flow out of outlet 19 into the waste pipe 16 via the overflow hose 20. The fact that the hose 18 is blocked will be evident as the sullage will also rise to the bottom of the tub 12, but will not overflow the tub.

All components of the diverter valve assembly 10 may be suitably moulded from PVC plastics material, and either threaded or glued together. However, the O-ring seal 22 is typically made of rubber.

The abovedescribed diversion valve can be easily installed in new plumbing installations, or retrofitted to existing installations, even by unskilled persons. As shown in FIG. 1, the diversion valve 10 can be fitted below a laundry tub simply by cutting out a short length of the pipe between the tub and the S-bend, and replacing that portion by the diversion valve.

The diverter valve assembly can be manufactured to any size or shape to suit the particular installation. It can be constructed simply using low cost materials, and is easy to operate. The diverter valve 10 provides the user with means to selectively divert sullage for irrigation or other purposes as required, and in a safe manner, thereby reducing overall water consumption.

It is to be noted that the valve may be partially opened to permit a proportion of the sullage to be diverted to hose 18, while the remainder flows to waste 16.

The foregoing describes only one embodiment of the invention, and modifications which are obvious to those skilled in the art may be made thereto without departing from the scope of the invention.

For example, the valve assembly may be provided with a plurality of inlets 14 Which are connected to respective sources of sullage, e.g. a laundry tub, a shower, a bath tub, etc. Furthermore, the diverter valve assembly 10 need not be inserted below a laundry tub, but may be fitted to a waste pipe at another location therealong.

The valve itself may take any suitable form consistent with its function of selectively closing the outlet to the waste and diverting the sullage to another outlet.

I claim:

1. A sullage diversion valve assembly comprising a housing having an inlet, which in use, is connected to a source of sullage, a first outlet, which in use, is connected to waste, and a second outlet; valve means selectively operable by a user to cause sullage received through said inlet to pass through either the first outlet or the second outlet; and an overflow outlet adapted to be connected to waste via a conduit, the overflow outlet being located, in use, at a higher level than the second outlet.

2. A valve assembly as claimed in claim 1, wherein the valve means comprises a manually operable rotary valve.

3. A valve assembly as claimed in claim 2, wherein the housing is in the form of tubular casing, and the rotary valve comprises a rotor member rotatable within a tubular member connected to the tubular casing, the rotor member extending into the tubular casing, whereby when the rotor is in a first rotational position, the passage through the casing between the inlet and the first outlet is substantially closed, and when the rotor is in a second rotational position, the passage is open.

4. A valve assembly as claimed in claim 3, wherein the rotary valve further comprises a handle formation connected to the outer end of the rotor, and further wherein the end face of the inner end of the rotor is angled obliquely to the axis of the rotor, and the axis of the tubular member is angled obliquely to the axis of the tubular casing.

5. A sullage diversion valve assembly comprising a housing having an inlet connected to a source of sullage, a first outlet connected to a waste pipe, a second outlet connected to a conduit, a manually operated valve selectively operable to cause sullage from the inlet to pass to either the first or second outlet; and an overflow outlet connected to the waste pipe via a conduit, the overflow outlet being located at a higher level than the second outlet.

6. A valve assembly as claimed in claim 5, wherein the valve means comprises a manually operable rotary valve.

7. A valve assembly as claimed in claim 6, wherein the housing is in the form of a tubular casing, and the rotary valve comprises a rotor member rotatable within a tubular member connected to the tubular casing, the rotor member extending into the tubular casing, whereby when the rotor is in a first rotational position, the passage through the casing between the inlet and the first outlet is substantially closed, and when the rotor is in a second rotational position, the passage is open.

8. A valve assembly as claimed in claim 7, wherein the rotary valve further comprises a handle formation connected to the outer end of the rotor, and further wherein the end face of the inner end of the rotor is angled obliquely to the axis of the rotor, and the axis of the tubular member is angled obliquely to the axis of the tubular casing.

* * * * *